US011982064B2

(12) United States Patent
Da Costa

(10) Patent No.: US 11,982,064 B2
(45) Date of Patent: May 14, 2024

(54) METHOD FOR TREATING SOIL

(71) Applicant: SOLETANCHE FREYSSINET, Rueil Malmaison (FR)

(72) Inventor: Francisco Da Costa, Rueil Malmaison (FR)

( * ) Notice: Subject to any disclaimer, the term of this patent is extended or adjusted under 35 U.S.C. 154(b) by 128 days.

(21) Appl. No.: 17/297,002

(22) PCT Filed: Nov. 4, 2019

(86) PCT No.: PCT/FR2019/052597

§ 371 (c)(1),
(2) Date: May 26, 2021

(87) PCT Pub. No.: WO2020/109682

PCT Pub. Date: Jun. 4, 2020

(65) Prior Publication Data

US 2022/0025603 A1 Jan. 27, 2022

(30) Foreign Application Priority Data

Nov. 27, 2018 (FR) ..... 1871928

(51) Int. Cl.
*E02D 3/12* (2006.01)

(52) U.S. Cl.
CPC ..... *E02D 3/12* (2013.01)

(58) Field of Classification Search
CPC ..... E02D 3/12; E21B 49/006; E21B 33/1243; E21B 33/127
See application file for complete search history.

(56) References Cited

U.S. PATENT DOCUMENTS 4,302,132 A * 11/1981 Ogawa ..... E02D 3/12 405/269
4,514,112 A * 4/1985 Sano ..... E02D 3/12 405/269
4,545,702 A 10/1985 Sano et al.
5,032,042 A * 7/1991 Schuring ..... E21B 43/2607 166/308.1

(Continued)

FOREIGN PATENT DOCUMENTS

EP 1520936 A2 4/2005
FR 2529612 A1 1/1984

(Continued)

OTHER PUBLICATIONS

English language abstract of JP2017048586.

*Primary Examiner* — Benjamin F Fiorello
(74) *Attorney, Agent, or Firm* — Cabinet Beau de Loménie; Brian Gordaychik; Jonathan Bingham

(57) ABSTRACT

A method for treating soil is provided. The method comprises supplying a tube; making a borehole having a borehole depth in the soil; positioning the tube in the borehole at a first predetermined depth less than the borehole depth; introducing at least one first blocking element into the borehole at a second predetermined depth between the first predetermined depth and the borehole depth, the at least one first blocking element being configured to block the borehole in order to define an injection zone; and injecting an injection fluid into the injection zone while removing cuttings located between the tube and the lateral wall of the borehole.

23 Claims, 13 Drawing Sheets

(56) References Cited

U.S. PATENT DOCUMENTS

| | | | | |
|---|---|---|---|---|
| 2002/0108784 | A1* | 8/2002 | Kruspe | E21B 49/06 175/50 |
| 2015/0219783 | A1* | 8/2015 | Sitka | G01V 3/26 324/326 |
| 2017/0051585 | A1* | 2/2017 | Hazel | E21B 47/06 |
| 2018/0106124 | A1* | 4/2018 | Hazel | E21B 29/00 |
| 2020/0248524 | A1* | 8/2020 | Corre | E21B 43/26 |
| 2021/0095562 | A1* | 4/2021 | Pfeiffer | E21B 49/08 |
| 2021/0131246 | A1* | 5/2021 | Jamison | E21B 43/26 |

FOREIGN PATENT DOCUMENTS

| | | | | |
|---|---|---|---|---|
| JP | H0776818 | * | 3/1995 | E02D 3/12 |
| JP | 2017048586 | A | 3/2017 | |

* cited by examiner

Fig. 1]
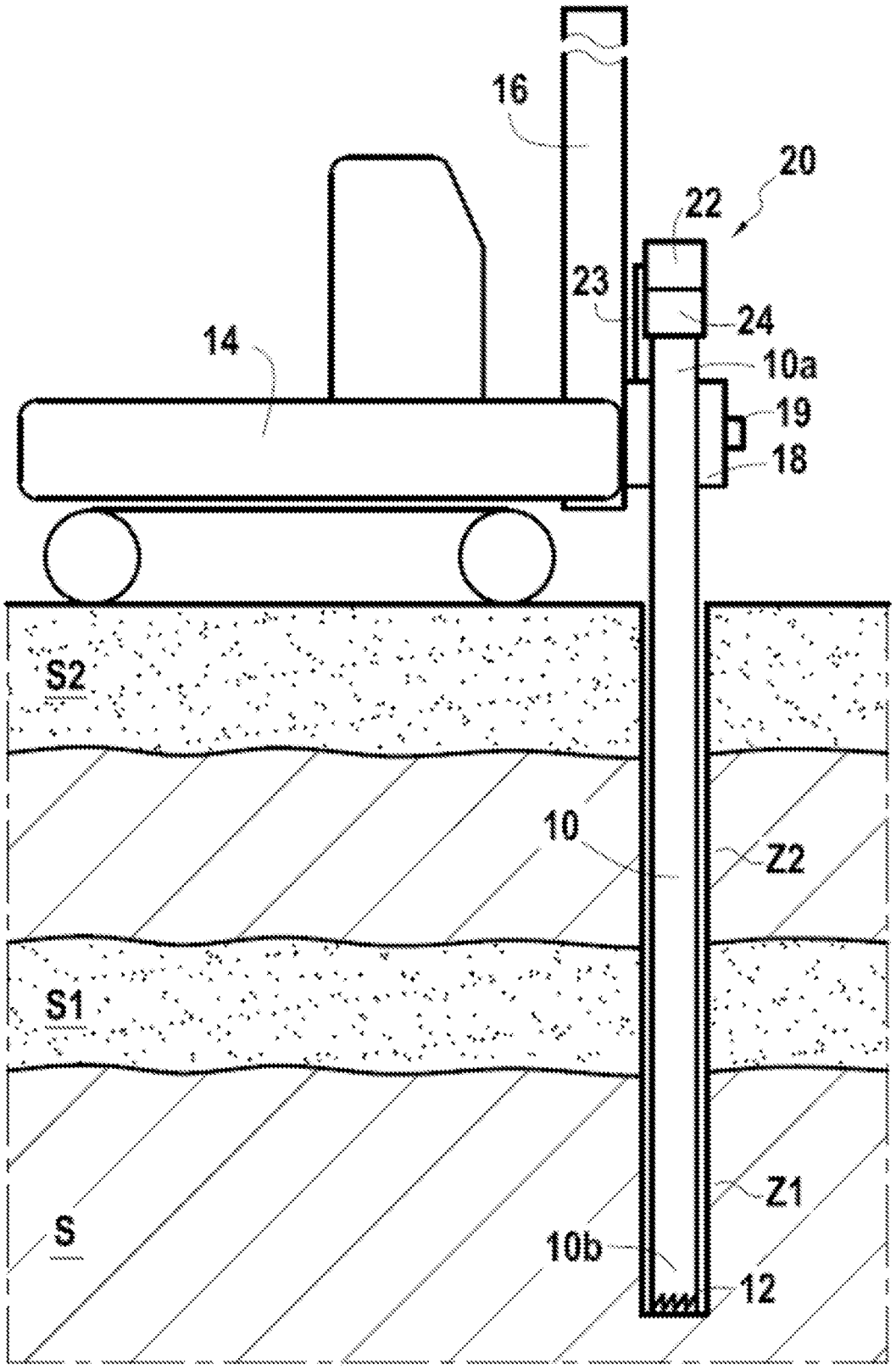

[Fig. 2]
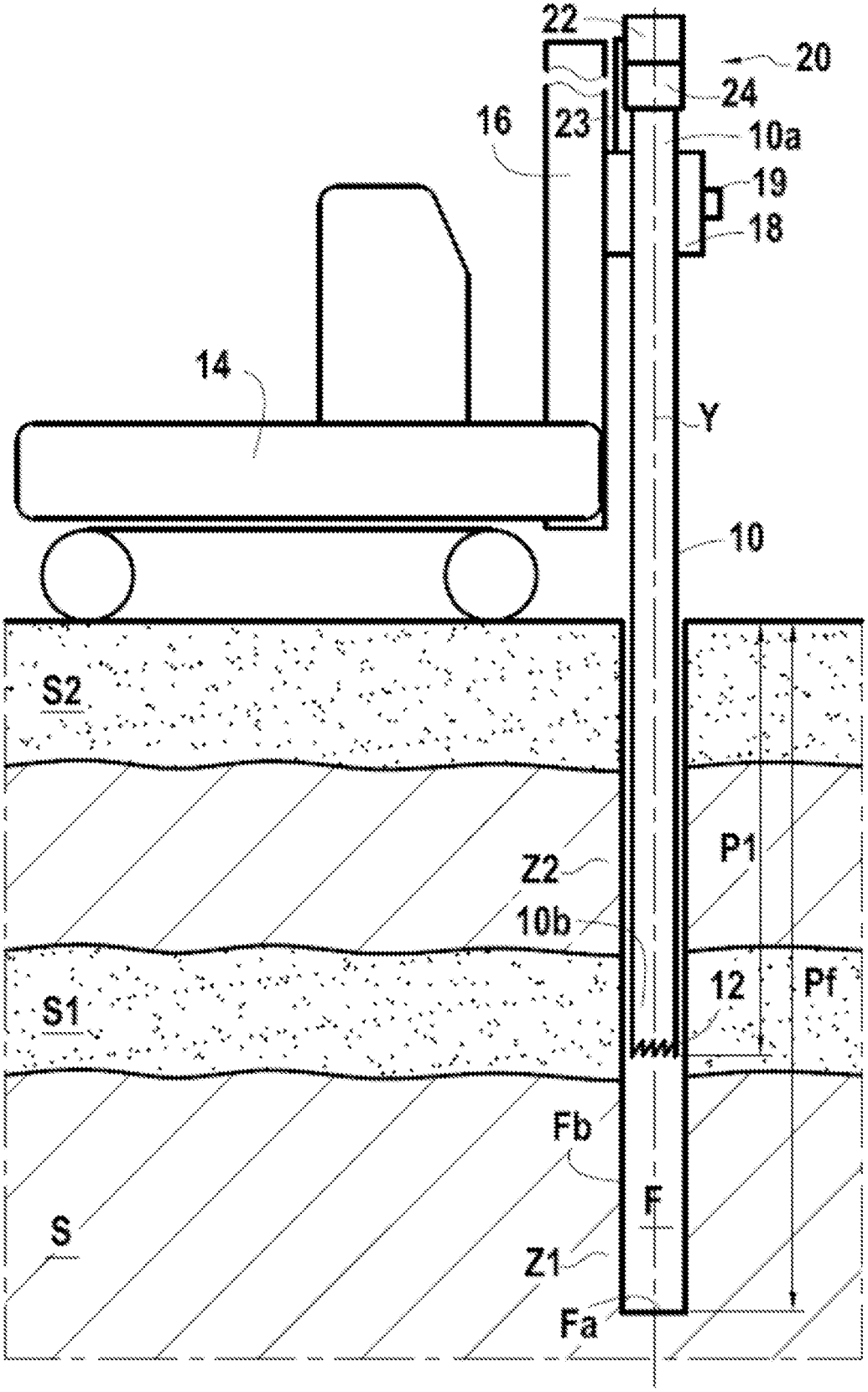

[Fig. 3]
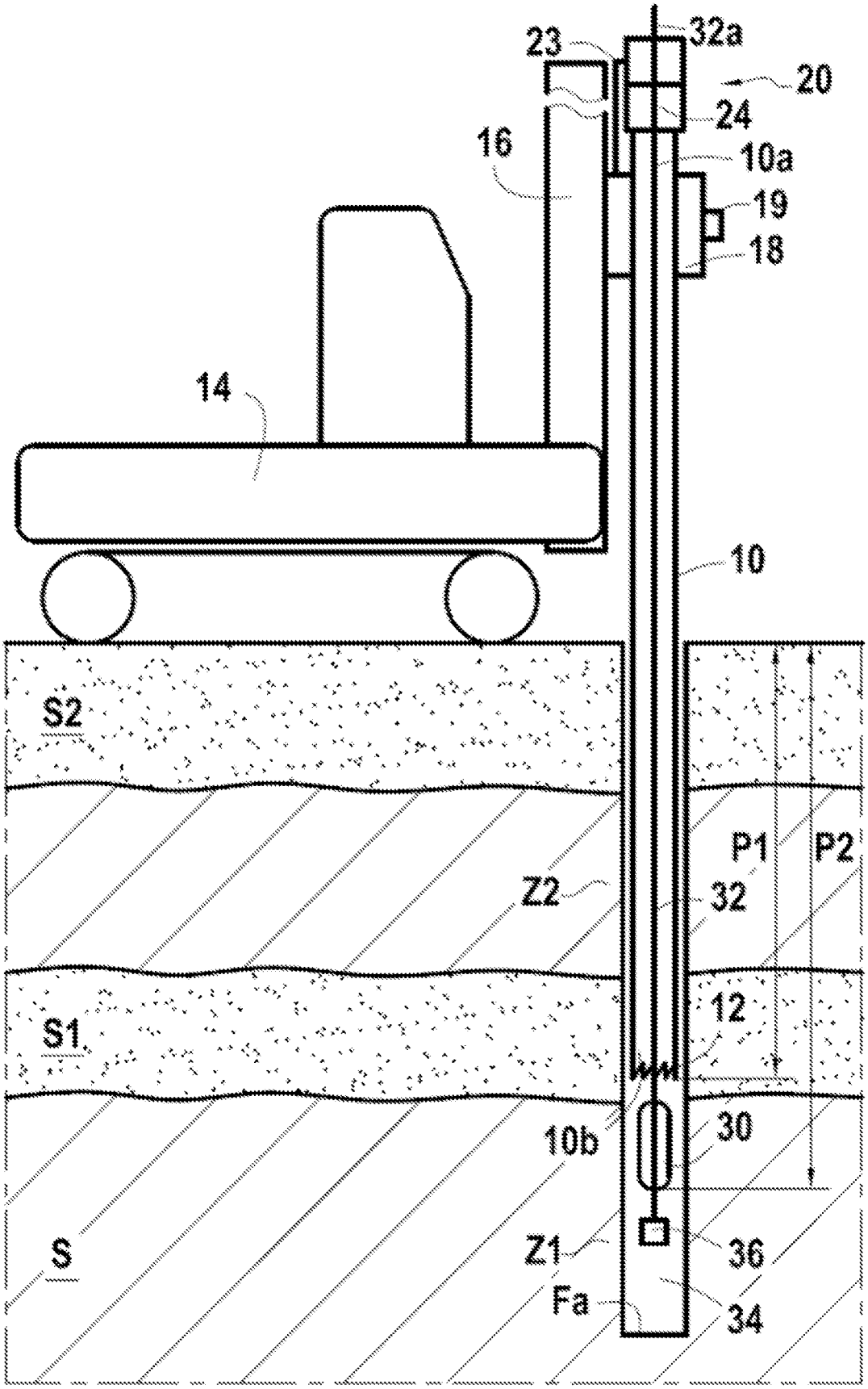

[Fig. 4]
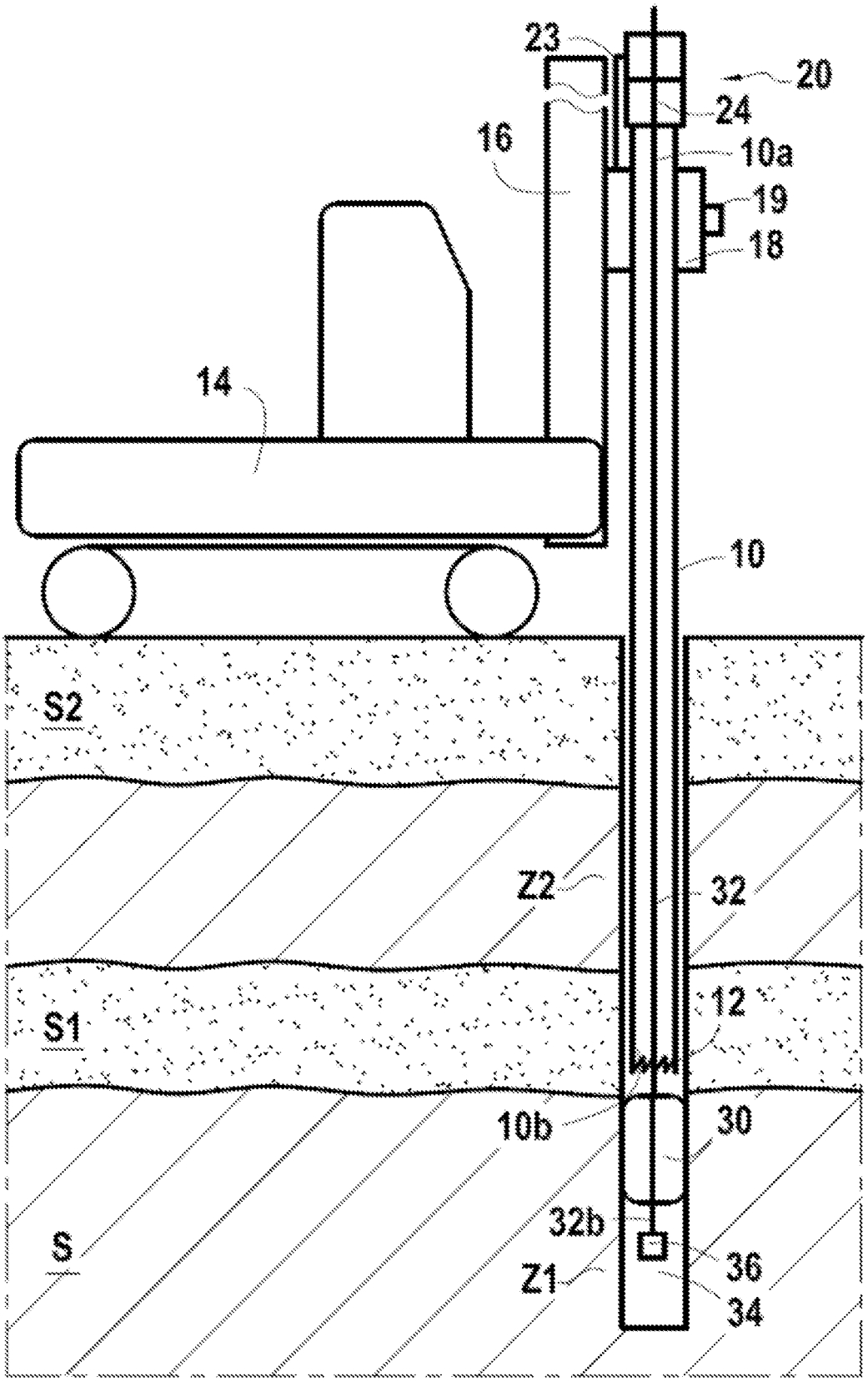

[Fig. 5]
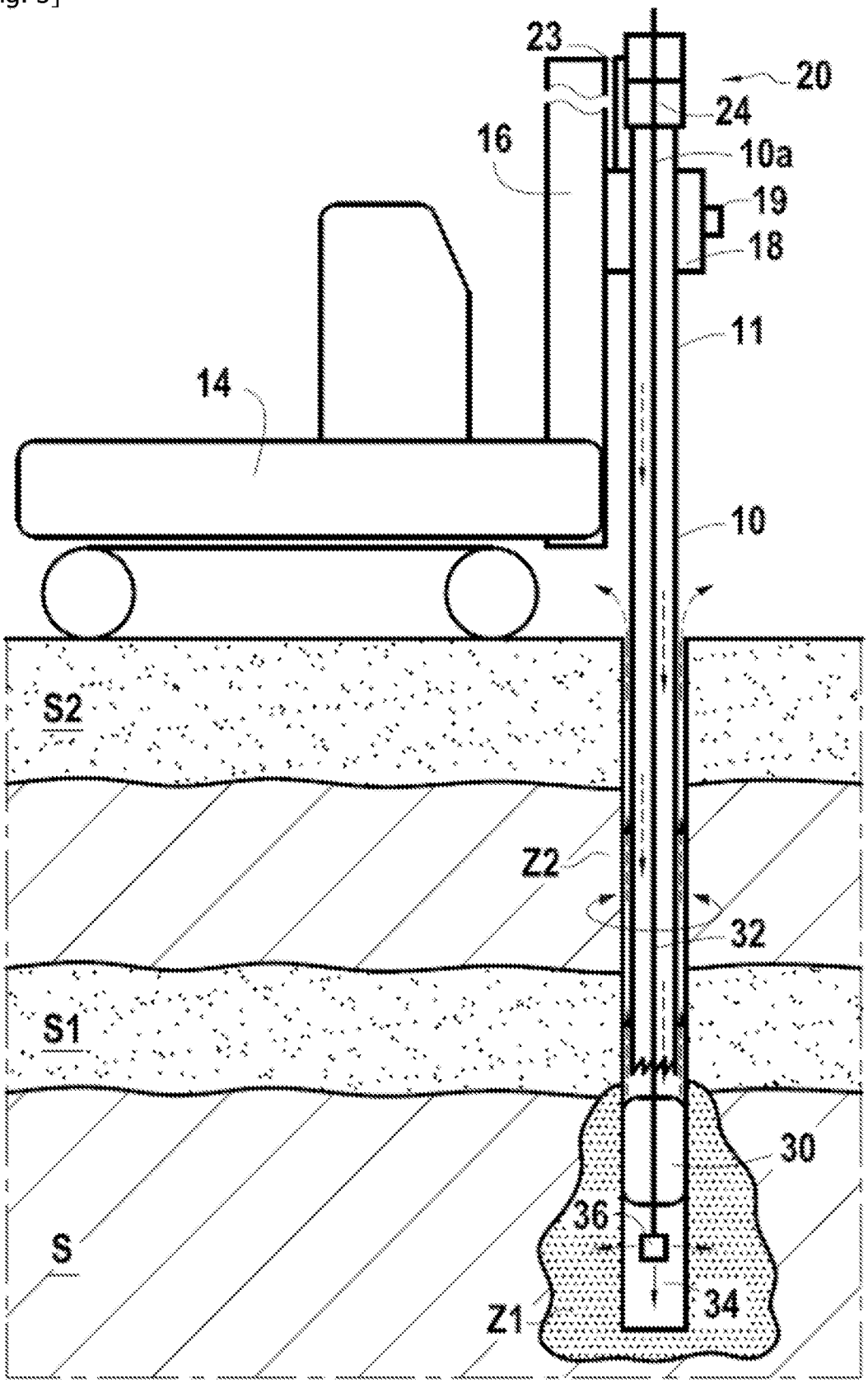

[Fig. 6]
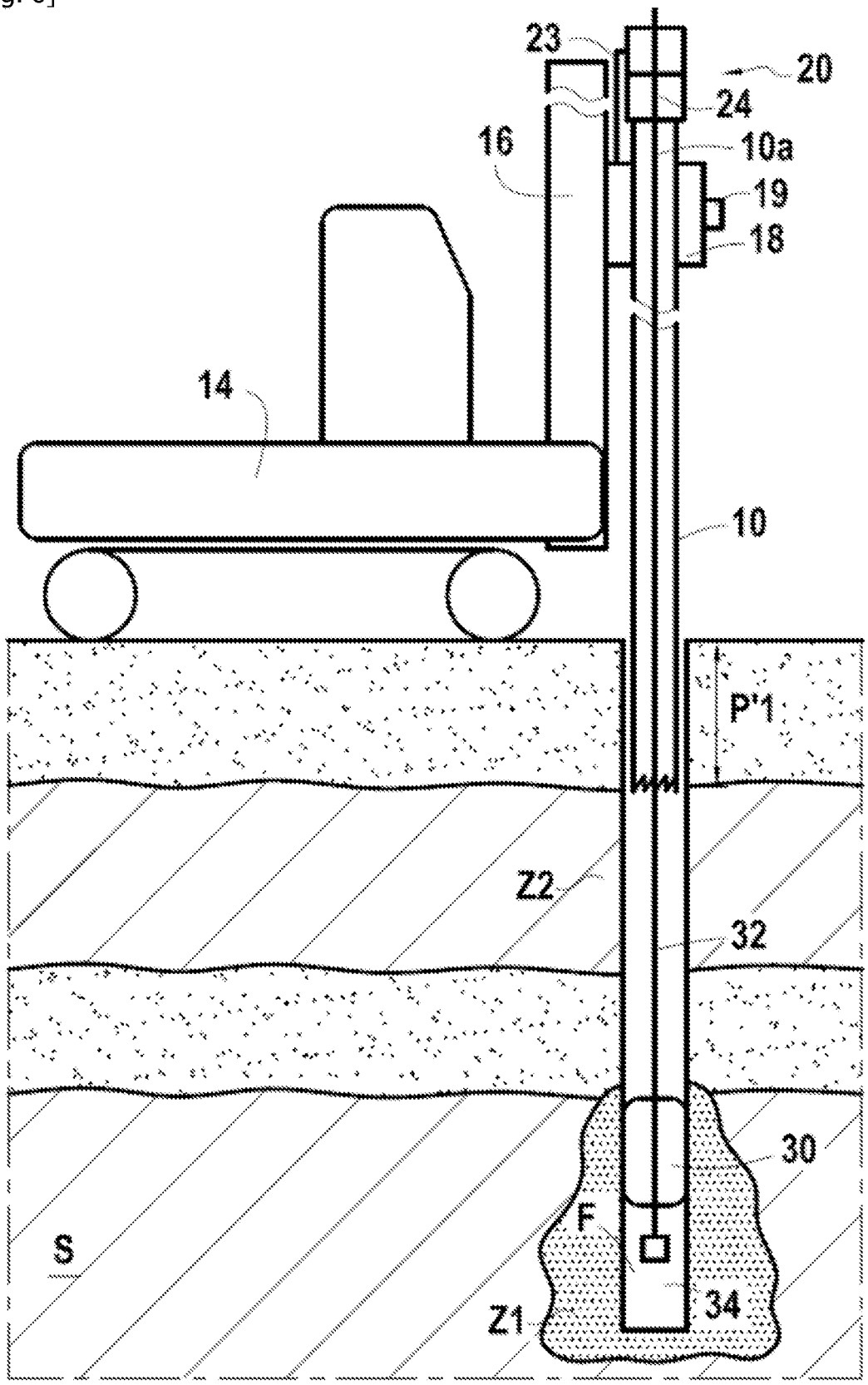

[Fig. 7]
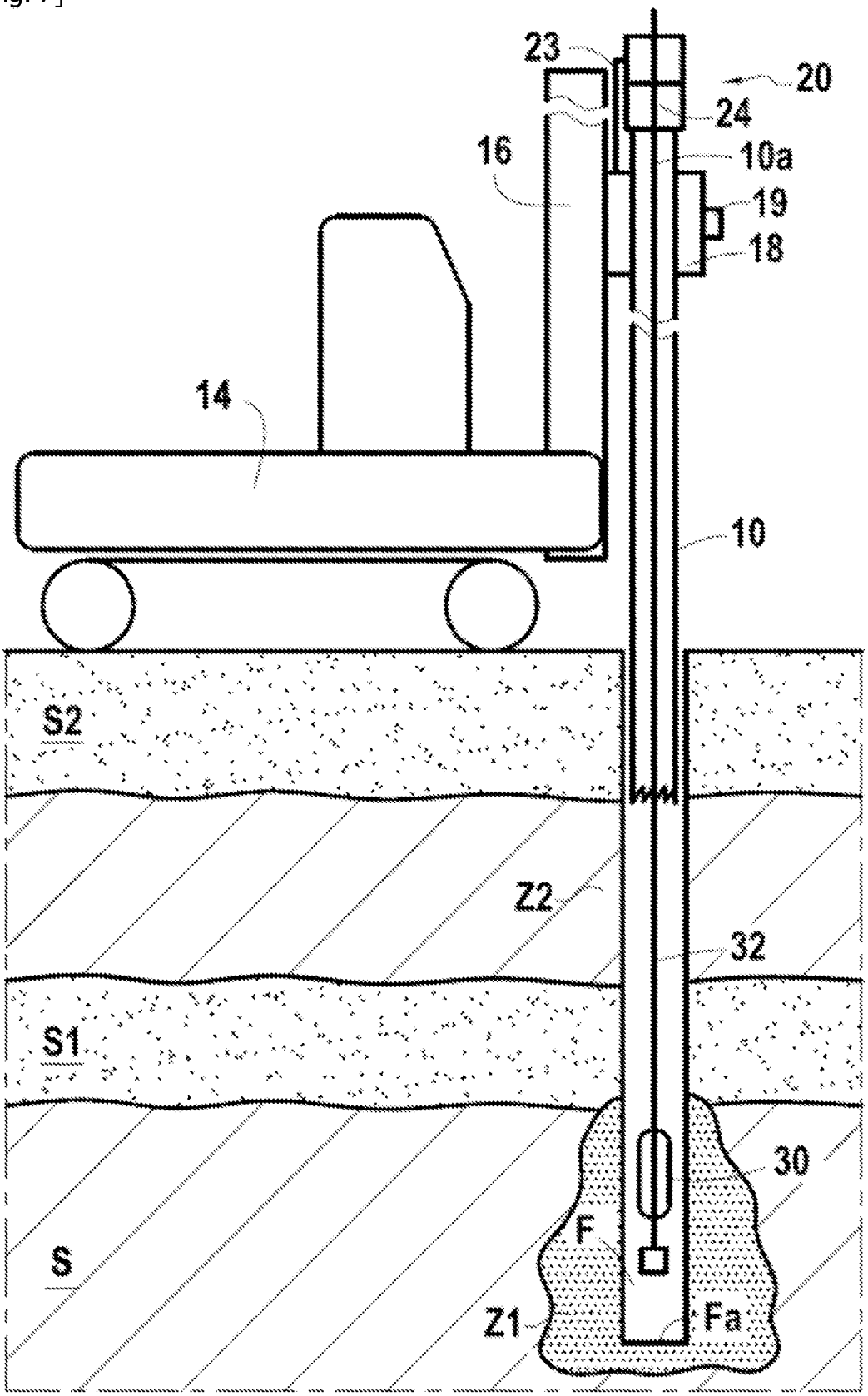

[Fig. 8]
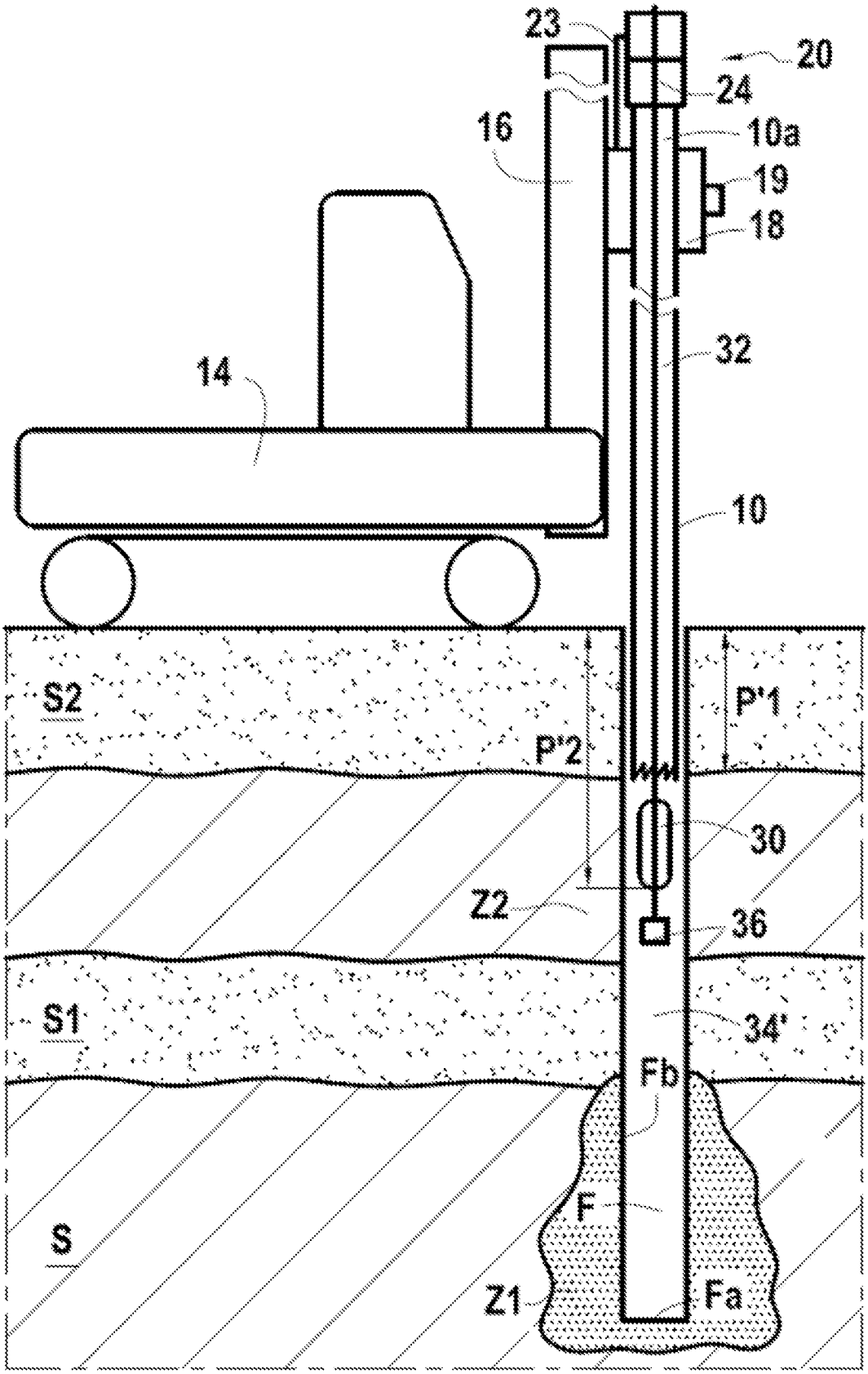

[Fig. 9]
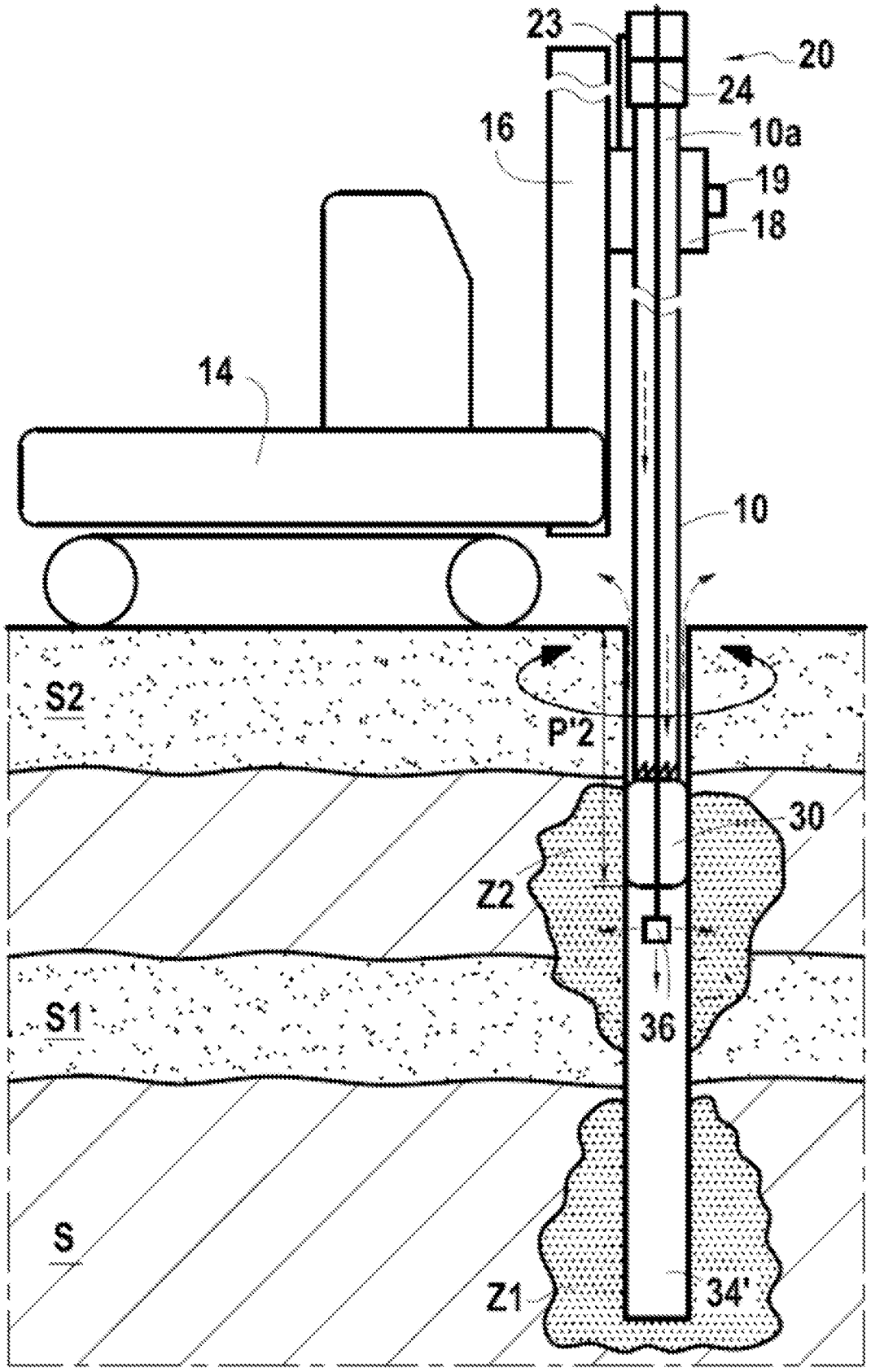

[Fig. 10]
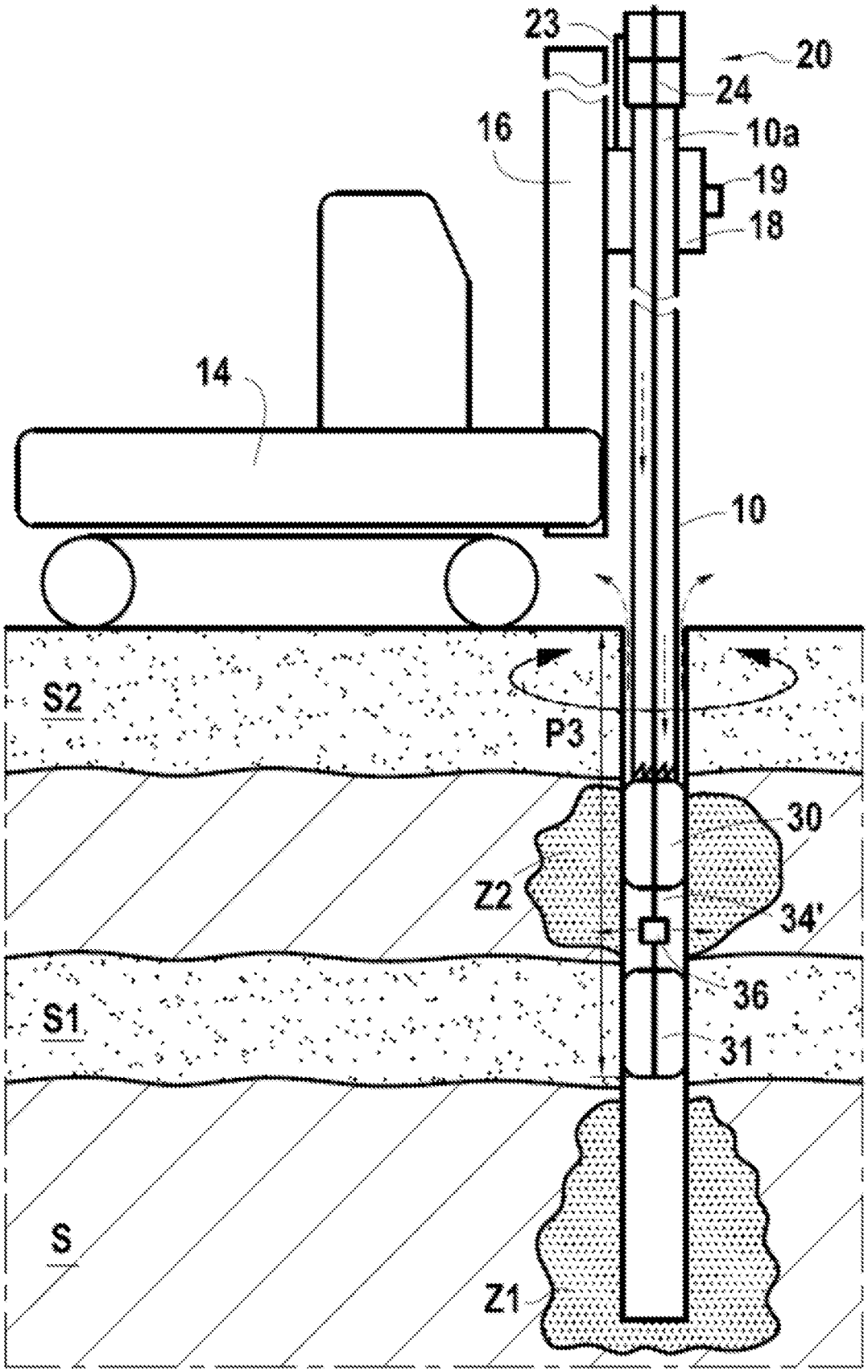

[Fig. 11]
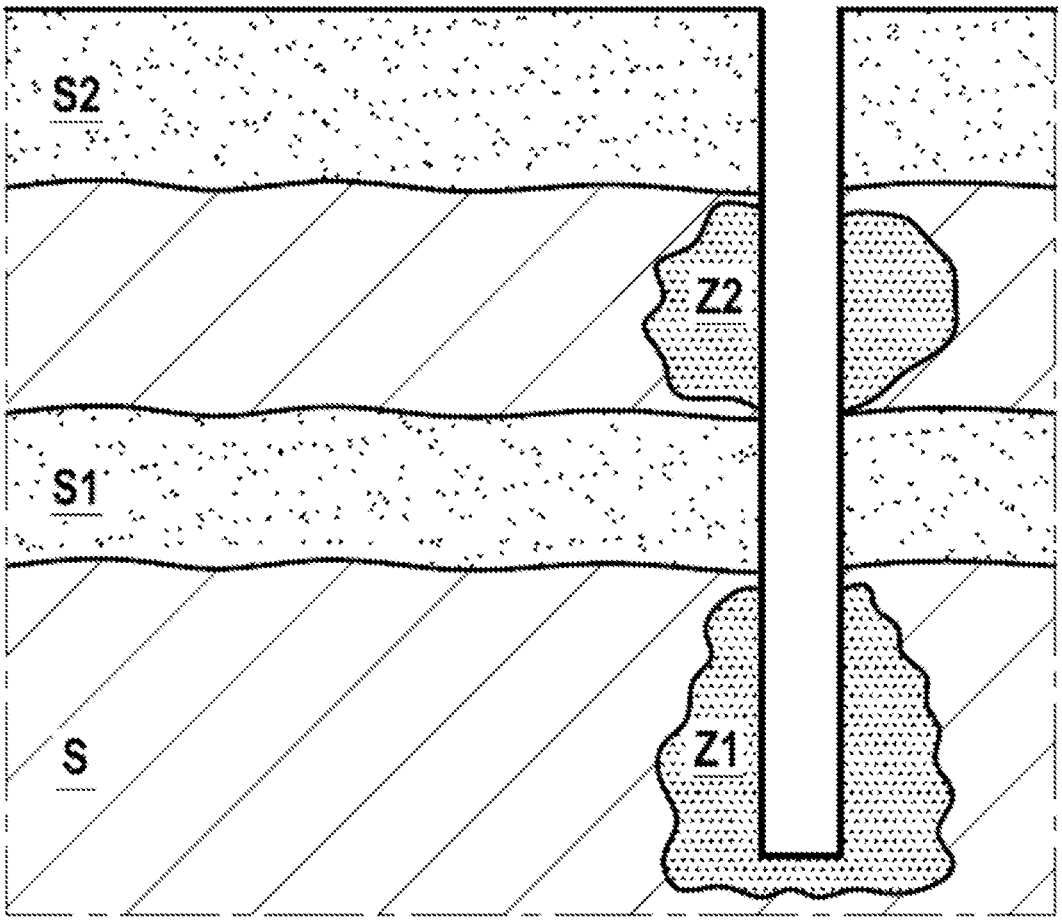

[Fig. 12]
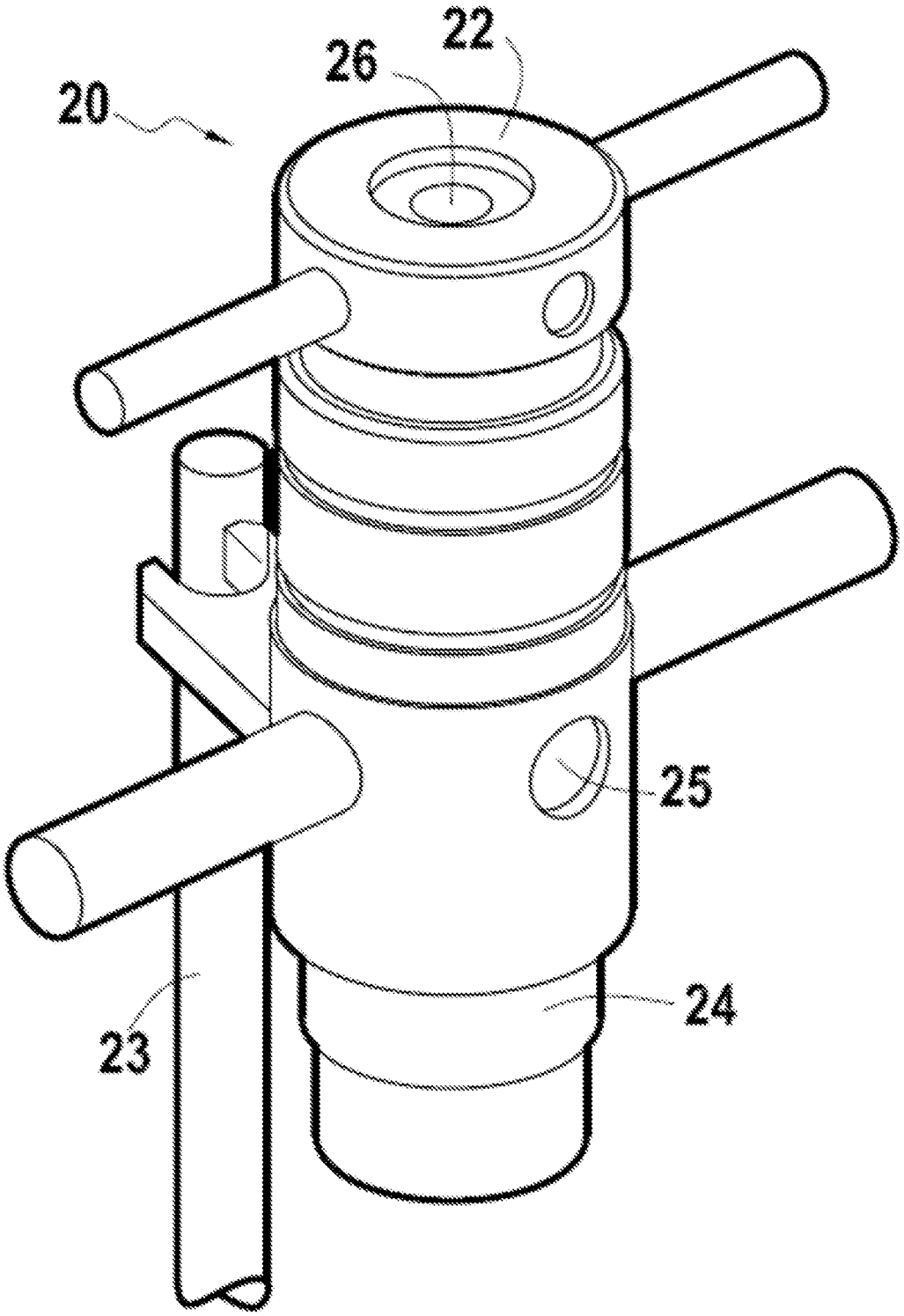

[Fig. 13]
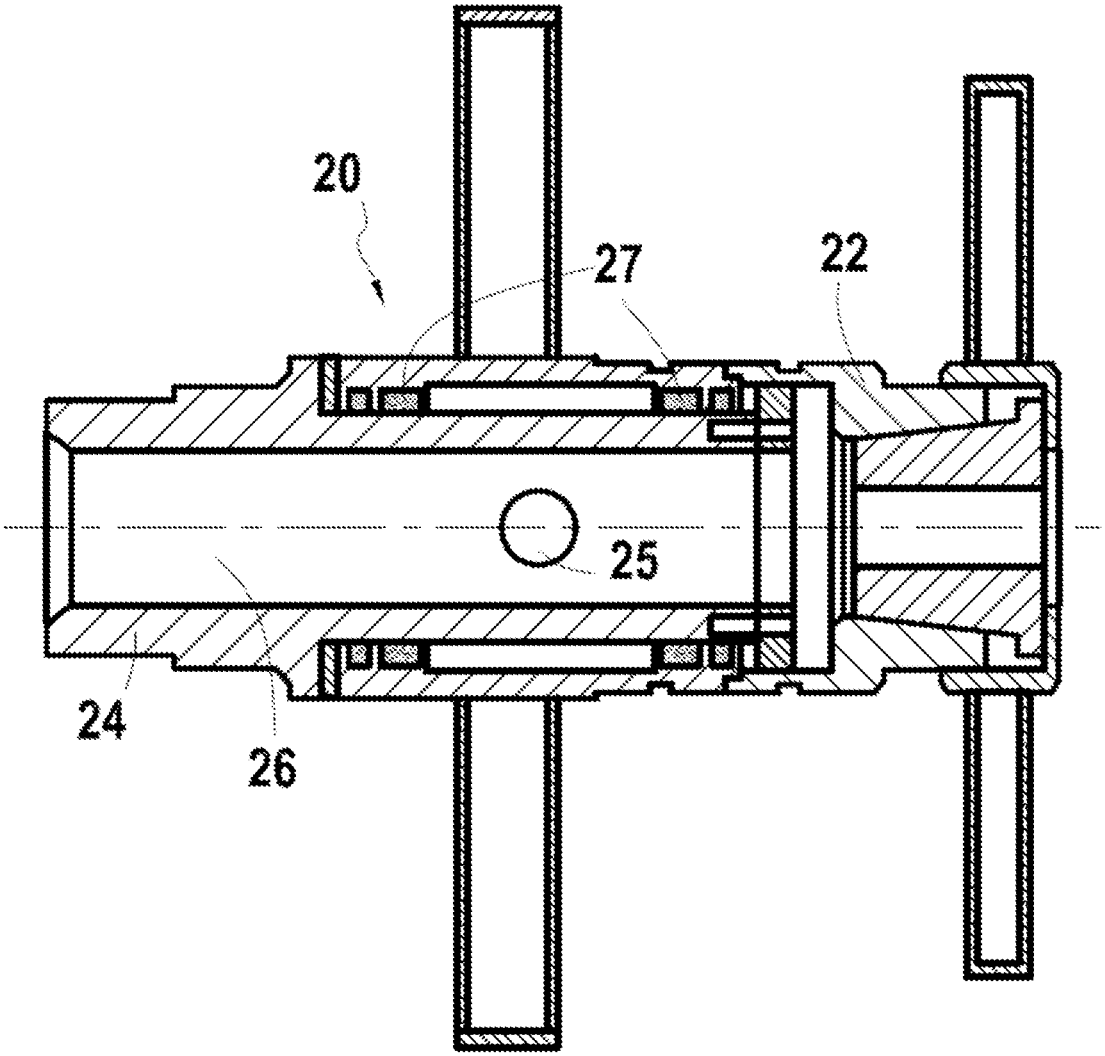

METHOD FOR TREATING SOIL

TECHNICAL FIELD

The present invention relates to the field of treating soil in order to modify its physical properties such as for example waterproofing or solidity. The invention relates more precisely to a method for treating soil of this type.

PRIOR ART

It is known to inject into soil injection fluids such as waterproofing or stiffening products. In particular, when a stiffening product is injected into soil, it fills in the asperities of said soil or fissures present in the case of rocky soil, in order to consolidate the latter.

To treat the soil in depth, methods are known in which a borehole is made, then injection fluid is injected from an injection zone inside the borehole, to the lateral wall of said borehole. The injection fluid then spreads into the soil, so that a portion of the soil is then treated. In the presence of strongly fractured or very unstable ground, it can however be necessary to reinforce the lateral wall of the borehole. Also to avoid this wall collapsing and plugging the borehole, a tube is traditionally introduced into the borehole, above the injection zone, at the unstable parts of the soil.

This tube allows maintaining the lateral wall of the borehole and proceeding with the treatment of the soil independently of the state of the soil at the different depths considered along the borehole. When the injection of the fluid is finished, the tube is extracted from the borehole.

One disadvantage of this type of method is that during the injection, the injection fluid is projected in part toward the tube so that it covers said tube and is infiltrated between the tube and the wall of the borehole. The injection fluid increases friction between the tube and the soil, which strongly complicates the movement or the extraction of the tube out of the borehole. In the worst case, the injection fluid solidifies so that the tube is captured in the injection fluid, particularly when a stiffening product is involved. The tube is then blocked in the borehole by the injection fluid, in which case it must be abandoned in the borehole, which is not desirable.

It is known to use a shutter positioned between the bottom of the borehole and the tube in order to delimit an injection zone. The shutter allows preventing the projection of injection fluid directly onto the tube, and therefore limits the risk of blocking of the tube in the borehole.

It is understood however that, once injected, the injection fluid percolates and propagates step by step into the soil so that it bypasses the shutter. The injection fluid, possibly mixed with particles of soil, then forms cuttings which finally infiltrate between the tube and the lateral wall of the borehole. The shutter is therefore insufficient for avoiding the blockage of the tube in the borehole caused by the injection fluid.

DISCLOSURE OF THE INVENTION

One goal of the present invention is to propose a method for treating soil correcting the aforementioned problems.

To this end, the invention relates to a method for treating soil comprising the following steps:

a tube is supplied having a distal end;

a borehole is made in the soil, the borehole having a bottom, a lateral wall, a borehole depth and extending in a boring direction;

the tube is positioned in the borehole at a first predetermined depth less than the borehole depth;

at least one first blocking element is introduced into the borehole at a second predetermined depth comprised between the first predetermined depth and the borehole depth, so that it extends between the distal end of the tube and the bottom of the borehole, said at least one first blocking element being configured to block the borehole in order to define an injection zone located between said at least one first blocking element, the bottom of the borehole and the lateral wall of the borehole; then an injection fluid is injected into the injection zone while carrying out a step of removing the cuttings located between the tube and the lateral wall of the borehole.

The method according to the invention allows treating one or more selected portions of soil by means of the injection fluid having physical properties suited to the desired treatment.

The borehole is preferably made by means of a boring machine comprising a soil cutting tool. It has substantially the shape of a cylinder having a diameter. The borehole advantageously comprises an edge in the upper part, leading out of the borehole. The borehole is preferably made so as to pass through the soil portion to be treated, and the depth of the borehole is selected so that the soil portion to be treated is located between the bottom and the edge of the borehole.

The boring direction can be substantially vertical or inclined with respect to the vertical.

The tube preferably has the shape of a cylinder having a diameter slightly smaller than the diameter of the borehole, so that it can easily be introduced into said borehole. It preferably had a length less than the depth of the borehole.

The tube is preferably configured to be located in the borehole facing an unstable or fractured soil portion, likely to collapse. It then allows maintaining the lateral wall of the borehole at a height equal to the first predetermined depth, so as to prevent said lateral wall from collapsing.

The distal end of the tube is configured to be oriented toward the bottom of the borehole when the tube is introduced into the borehole. The first predetermined depth is the depth at which said distal end of the tube extends when it is placed in the borehole.

Moreover, the tube preferably comprises a proximal end configured to extend outside the borehole.

Preferably, the borehole tube can be moved in the borehole so as to successively sustain the lateral wall of the borehole at different depths. In particular, the tube can be moved in a direction opposite to the bottom of the borehole, so as to progressively increase the height of the injection zone.

The injection fluid can be injected successively at different depths in order to treat a plurality of soil portions.

Without departing from the scope of the invention, the method can comprise the supply and the positioning of a plurality of tubes at different depths in order to consolidate the lateral wall of the borehole at said different depths.

The injection fluid is injected from the injection zone, inside the borehole, preferably toward the lateral wall of the borehole.

The first blocking element advantageously has a cylindrical shape and a diameter substantially equal to the diameter of the borehole. When it is introduced into the borehole, it preferably forms a hermetic barrier in order to prevent the projection of fluid out of the projection zone and therefore directly toward the tube.

It is understood, however, that the injection fluid risks infiltrating into the soil and propagating in it by percolation. Also, the injection fluid, possibly mixed with soil particles, risks bypassing the first blocking element and coming into contact with the borehole tube, via the soil. The injection fluid, possibly mixed with soil particles, then forms cuttings which infiltrate between the tube and the lateral wall of the borehole. These cuttings perturb the movement and the extraction of the tube with respect to the borehole. The step of removing the cuttings then allows removing all or part of these cuttings and therefore injection fluid in contact with the tube. One advantage is to prevent the tube from being caught in the injection fluid, in particular when a stiffening product such as a cement is involved. The step of removing the cuttings also allows relieving the tube and reducing friction between the tube and the lateral wall of the borehole, generated by said cuttings.

The step of removing the cuttings therefore facilitates the movement of the tube as well as the extraction of said tube out of the borehole. The cuttings are removed to the outside of the borehole and can be treated and subsequently re-used.

Without limitation, the removal of the cuttings can be carried out as of the beginning of the injection of the injection fluid or in a deferred manner. The step of removing cuttings is preferably carried out prior to the solidification of the injection fluid in contact with the tube, particularly when a grout is involved, a cement grout for example.

Preferably, the step of removing the cuttings comprises the cleaning of the outer surface of the tube. One advantage is to remove all or part of the injection fluid which has infiltrated between the lateral wall of the borehole and said outer surface of the tube. The cleaning of the outer surface of the tube allows unsticking and removing the cuttings until the outer surface of the tube is substantially relieved of injection fluid and of cuttings. This also allows reducing friction between the tube and said lateral wall of the borehole so as to further facilitate the movement of the extraction of the tube out of the borehole.

The part of the tube which is located in the soil is preferably cleaned.

Without limitation, the step of cleaning the outer surface of the tube can be carried out by aspiration of the cuttings, by injecting a washing fluid, by rubbing the outer surface of the tube or by any other technique allowing reducing the quantity of cuttings covering said outer surface of the tube.

Advantageously, the step of cleaning the outer surface of the tube comprises the rotation of said tube around the boring direction. This rotation allows avoiding the solidification of the injection fluid in contact with the tube and therefore the blockage of the tube in the borehole. In addition, the rotation of the tube has a tendency to move the cuttings toward the ends of the tube and therefore of cleaning the outer surface of the tube. Moreover, the rotation of the tube generates friction between the outer surface of the tube and the lateral wall of the borehole, allowing unsticking the cuttings covering said outer surface of the tube.

The speed of rotation of the tube is preferably relatively small, on the order of a few revolutions per minute. The speed of rotation of the tube can advantageously be controlled, monitored and recorded.

The rotation of the tube can be controlled manually by an operator or triggered automatically in response to a triggering signal. Preferably, the step of rotating the tube is carried out by means of a movement device configured to drive the tube in rotation around the boring direction.

Without limitation, the movement device can also be configured to move the tube in translation, particularly in the boring direction. This allows the tube to be easily introduced into the borehole and to easily adjust the first predetermined depth to which the tube extends in the borehole, while putting the tube in rotation.

The movement device is located advantageously outside the borehole and cooperates with the tube so that the proximal end of the tube also extends outside the borehole. The torque applied to the tube during its rotation can advantageously be controlled.

Advantageously, the distal end of the tube bears a cutting member, and the step of boring into the soil is carried out by means of the tube moving in the soil in the boring direction until the borehole depth. One advantage is to accomplish the boring and the introduction of the tube into the borehole in a single step. The use of a boring tool distinct from the tube and a subsequent step of introducing the tube into the borehole are dispensed with. This allows saving time and reducing the number of tools necessary for the implementation of the treatment method.

Advantageously, the diameter of the tube is substantially equal to the diameter of the borehole, as a result of which the tube molds itself substantially to the shape of the borehole. One advantage is to reduce as much as possible the subsidence of the lateral wall of the borehole toward the inside of the borehole. The risk of collapse of the lateral wall of the borehole is further reduced.

Preferably, the method comprises steps according to which a torque sensor is supplied, the resisting torque applied to the tube is measured by means of the torque sensor, and a possible presence of cuttings in contact with the tube is detected due to the measured resisting torque.

The presence of cuttings and particularly of injection fluid in contact with the tube induces friction opposing the rotation of said tube. This generates a resisting torque opposing the rotation of the tube. Also, by detecting the presence of such a resisting torque, or of a resisting torque greater than a predetermined threshold applied to the tube by means of a torque sensor, it is possible to deduce the presence of cuttings perturbing the rotation of the tube.

One advantage is to be able to trigger the rotation of the tube only in the presence of cuttings in contact with said tube. This allows reducing the wear of the tube as well as the costs of fuel necessary for its rotation.

Preferably, said at least one first blocking element has a retracted position in which it can be moved in the borehole and a deployed position in which it cooperates with the lateral wall of the borehole to block the borehole in order to define said injection zone. One advantage is to be able to easily introduce the blocking element into the borehole. It is preferably introduced into the borehole in the retracted position, moved until the second predetermined depth, the placed in the deployed position.

Another advantage is to be able to adjust the position of the first blocking element at any time, for example when it is necessary to treat successively different soil portions at different depths. In this case, the first blocking element is placed in the retracted position, moved, then again place in the deployed position. This also allows adjusting the dimensions of the injection zone.

Advantageously, said at least one first blocking element is inflatable. In the retracted position, the blocking element is deflated while it is inflated when it is placed in the deployed position. One advantage is to be able to easily and rapidly place the first blocking element into the retracted position or into the deployed position. Another advantage is that the first blocking element molds itself more effectively to the lateral wall of the borehole once inflated, which reduces the risk of leakage and therefore of infiltration of the injection fluid between said lateral wall of the borehole and said first blocking element.

Without limitation, the blocking element can be linked to an inflation member located outside the borehole, allowing it to be inflated to deflated from outside the borehole.

Preferably, the introduction of said at least one first blocking element into the borehole comprises the introduction of said first blocking element, in the retracted position, into the tube and movement of said first blocking element along the tube until the second predetermined depth. The tube is therefore put in place in the borehole before introducing and positioning the first blocking element. One advantage is to reduce the risk that said first blocking element is damaged due to a collapse of the lateral wall of the borehole. In addition, the tube allows guiding the movement of the first blocking element in the borehole. The transverse dimensions of the first blocking element in the retracted position are less than the diameter of the tube.

Advantageously, the injection of the fluid is accomplished by means of an injection device comprising an injection channel extending inside the tube and leading into the injection zone.

The injection channel is preferably connected to a supply source of injection fluid located outside the borehole and allows bringing the injection fluid from outside the borehole until the injection zone. The tube allows protecting the injection channel from the collapse of the lateral wall of the borehole and reduces the risk of damage to said injection channel.

Preferably, the injection device comprises an injection nozzle located at the distal end of the injection channel and configured to be introduced into the injection zone at a desired depth. The injection device is preferably moved along the borehole, into the injection zone, in order to treat a plurality of soil portions at different depths.

Advantageously, the injection channel passes through said at least one first blocking element, as a result of which the injection fluid can easily be injected into the injection zone, between the first blocking element and the bottom of the borehole. The first blocking element therefore extends radially around the injection channel. When it is in the deployed position, the first blocking element molds itself substantially to the shape of the injection channel, so as to reduce the risk of infiltration of the injection fluid between said first blocking element and said injection channel.

Preferably, the first blocking element and the injection channel are simultaneously introduced into the borehole.

Preferably, the treatment method comprises a step in which a second blocking element is introduced into the borehole at a third predetermined depth comprised between the second predetermined depth and the borehole depth, so that it is located between said at least one first blocking element and the bottom of the borehole, said second blocking element being configured to block the borehole so that the injection zone extends between the first blocking element, the second blocking element and the lateral wall of the borehole.

The second blocking element prevents the injection of fluid directly between the bottom of the borehole and said second blocking element. One advantage is to delimit an injection zone of reduced height, considered in the boring direction. This allows treating a reduced and localized soil portion. Treating the soil until the bottom of the borehole is thus avoided if that is not necessary.

The second blocking element is preferably identical to the first blocking element. It is preferably inflatable and can be easily moved inside the borehole. Advantageously, the first and second blocking elements are fixed with respect to one another so that the distance separating them remains constant and they can be moved jointly.

According to a non-limiting variant, the first and second blocking elements can be movable with respect to one another. Also, in this variant, the height of the injection zone, considered in the boring direction, can be adjusted by moving the first and second blocking elements with respect to one another, in order to modify the distance separating them.

Advantageously, the first and second blocking elements are introduced into the borehole at the same time. They are both preferably introduced into the tube in the retracted position, positioned in the borehole then placed in the deployed position.

Preferably, the injection fluid is selected among a waterproofing product and a hardenable mud configured to consolidate the soil. The waterproofing product is particularly suitable when it is necessary to treat the soil to reduce infiltrations of water, under a dam for example. The use of a hardenable mud is particularly suitable for reinforcing the soil when it is desired to support a building.

As a variant, the injection fluid can be a grout or a concrete.

The injection fluid is preferably a fluid able to infiltrate and percolate in a porous soil, in order to propagate itself there to treat an extended soil portion around the borehole.

Advantageously, the step of cleaning the outer surface of the tube comprises the injection of a washing fluid around the tube. One advantage is to effectively eliminate the cuttings having infiltrated between the boring tube and the lateral wall of the borehole. The washing fluid carries off the cuttings located between the tube and the lateral wall of the borehole and effectively cleans the outer surface of the tube. The risk of the tube remaining caught in the borehole is further reduced.

The washing fluid is advantageously projected homogeneously over the entire outer surface of the tube. The injection of the washing fluid can be triggered starting with the injection of the injection fluid, or in a deferred manner.

Without departing from the scope of the invention, the step of cleaning the outer surface of the tube can comprise only the rotation of the tube, only the injection of the washing fluid or the rotation of the tube simultaneously with the injection of the washing fluid.

Preferably, the washing fluid is injected if a presence of cuttings in contact with the tube is detected by means of the torque sensor. One advantage is not to inject the washing fluid purposelessly, in the absence of cuttings in contact with the tube. This reduces the necessary quantity of washing fluid and therefore the costs associated with the cleaning of the tube.

Without limitation, the injection of the washing fluid can be triggered when the quantity of cuttings detected in contact with the tube is greater than a predetermined threshold.

Advantageously, the washing fluid is injected by the distal end of the tube toward the bottom of the borehole. The tube is used as a duct, so that the fluid is introduced into the tube from its proximal end, then brought until the distal end of the tube and finally injected into the borehole by its distal end. The washing fluid then fills an upper part of the borehole situated above the first blocking element and infiltrates between the outer surface of the tube and the lateral wall of the borehole. The cuttings present in this upper part of the borehole then mix with the washing fluid and are driven toward the upper end of the borehole. The washing fluid then drives the cuttings out of the borehole. This step allows removing the cuttings in effectively cleaning the outer surface of the tube.

Preferably, the step of injecting a washing fluid is carried out by means of an injection head configured to inject the washing fluid into the tube, the injection head comprising a fixed part and a pivoting part, the pivoting part being configured to cooperate with the tube. The injection head is preferably configured to be connected to a washing fluid supply source.

The injection head can advantageously be mounted removably on the proximal end of the tube, so that the pivoting part cooperates with said proximal end of the tube. The fixed part can be integral with a movement device of the tube.

The injection head advantageously comprises a hole passing through the fixed and pivoting parts in the boring direction. The hole therefore passes through the injection head, preferably all the way through. Said hole is configured to receive an injection channel. In addition, the first blocking element can advantageously be introduced by said through hole and guided until it enters the borehole via the injection head, then the tube.

The injection head advantageously comprises a lateral wall in which an opening is provided. Said through hole passes through the fixed part and the pivoting part and leads into the through hole. Said opening is configured to be connected to a washing fluid supply source. Thus, the fluid is injected into the hole passing through the injection head, via the opening provided in its lateral wall. The washing fluid is then guided into the tube. The washing fluid advantageously flows between the tube and the injection channel.

The invention also applies to a device for treating a soil in which a borehole is made having a bottom, a lateral wall, a borehole depth extending in a boring direction, the treatment device comprising:

- a tube having a distal end, said tube being configured to be positioned in the borehole at a first predetermined depth less than the borehole depth;
- at least one first blocking element configured to be introduced into the borehole at a second predetermined depth comprised between the first predetermined depth and the borehole depth, said at least one first blocking element being configured to block the borehole in order to define an injection zone located between said at least one blocking element, the bottom of the borehole and the lateral wall of the borehole;
- an injection device configured to inject an injection fluid into the borehole; and
- a device for removing the cuttings configured to remove the cuttings located between the tube and the lateral wall of borehole during the injection of the injection fluid into the borehole.

Preferably the device for removing the cuttings comprises a movement device configured to set the tube in rotation around the boring direction.

Advantageously, the device for removing the cuttings comprises an injection head for injecting a washing fluid around the tube.

BRIEF DESCRIPTION OF THE DRAWINGS

The invention will be better understood upon reading the description that follows of embodiments of the invention given by way of non-limiting examples, with reference to the appended drawings, in which:

FIG. 1 illustrates a first step of a method of treating soil in conformity with the invention;

FIG. 2 illustrates a second step of the method of treating soil in conformity with the invention;

FIG. 3 illustrates a third step of the method of treating soil in conformity with the invention;

FIG. 4 illustrates a fourth step of the method of treating soil in conformity with the invention;

FIG. 5 illustrates a fifth step of the method of treating soil in conformity with the invention;

FIG. 6 illustrates a sixth step of the method of treating soil in conformity with the invention;

FIG. 7 illustrates a seventh step of the method of treating soil in conformity with the invention;

FIG. 8 illustrates an eighth step of the method of treating soil in conformity with the invention;

FIG. 9 illustrates a ninth step of the method of treating soil in conformity with the invention;

FIG. 10 illustrates a variant of the ninth step of the method of treating soil of FIG. 9;

FIG. 11 illustrates the treated soil following the step illustrated in FIG. 10;

FIG. 12 illustrates an injection head of a treatment device according to the invention; and FIG. 13 illustrates a section view of the injection head of FIG. 12.

DESCRIPTION OF THE EMBODIMENTS

The invention applies to a method for treating soil. This method allows modifying the physical properties of a soil portion to be treated by injection of an injection fluid.

A first embodiment of the method, for treating a first portion Z1 of soil S and a second portion Z2 of said soil in conformity with the present invention, will be described by means of FIGS. 1 to 9. In this example, the soil S comprises in particular a first unstable part S1 and a second unstable part S2 extending above the first unstable part S1.

In conformity with the method according to the invention, a hollow and cylindrical tube 10 is suppled, having a proximal end 10*a* and a distal end 10*b*, opposite to the distal end 10*a*. In this example, the distal end 10*b* corresponds to the lower end of the tube and the proximal end 10*a* corresponds to the upper end of the tube 10. The tube 10 comprises at its distal end 10*b* a plurality of cutting teeth 12 forming a cutting member for cutting the soil S.

Without limitation, a boring machine 14 is also supplied, equipped with a mast 16 and with a movement device 18. In this non-limiting example, the movement device 18 is mounted sliding along the mast 16. The tube 10 cooperates with the movement device 18 so that said movement device 18 is configured to drive said tube 10 in rotation.

The speed of rotation of the tube 10 can advantageously be controlled and adjusted. Moreover, the movement device 18 also comprises a torque sensor 19, allowing measuring a resistant torque applied to the tube 10, opposing its rotation.

In this non-limiting example, the method comprises a first step of accomplishing boring by means of the tube 10. As illustrated in FIG. 1, the movement device 18 is translated downward along the mast 16, so as to move the tube 10 downward substantially vertically. In parallel, the movement device 18 drives the tube 10 in rotation, in order to cut the soil by means of cutting teeth 12, in order to accomplish said borehole F. As a variant, it could be contemplated to vibrate the tube 10 in order to cut the soil S. The tube therefore constitutes a boring tube.

Without departing from the scope of the invention, the borehole F could be accomplished by means of a boring tool independent of the tube.

The borehole F is accomplished so as to pass at least partially through the soil portions Z1, Z2 to be treated. As can be observed in FIG. 2, the borehole comprises a bottom Fa and a lateral wall Fb. In addition, said borehole F extends in a boring direction Y and until a borehole depth Pf.

In this example the borehole also passes through the first and second unstable soil parts S1, S2.

When the tube 10 has reached the desired borehole depth Pf illustrated in FIG. 1, a second step is carried out in which the movement device 18 is translated upward along the mast 16. The tube 10, cooperating with the movement device 18, is therefore also moved upward and rises along the borehole F. The tube is then positioned in the borehole at a first predetermined depth P1. More precisely, the tube is positioned so that its distal end 10*b* extends to said first predetermined depth P1.

Said predetermined depth P1 is less than the borehole depth Pf and less than the depth at which the first soil Z1 to be treated extends. Also, the tube extends above the soil portion to be treated and facing the first and second unstable soil parts S1, S2, likely to collapse. The tube 10 extends into the borehole F in the boring direction Y.

The tube then allows holding the lateral wall Fb of the borehole at a height equal to the first predetermined depth P1, and therefore in particular at the level of the first and second unstable soil parts S1, S2, in order to prevent said lateral wall Fb from collapsing. In addition, it is noted that the diameter of the tube 10 is very slightly less than the diameter of the borehole F so that it substantially molds itself to the lateral wall Fb of the borehole F. One advantage is to prevent even more effectively the collapse of the lateral wall of the borehole toward the interior of said borehole F.

The tube 10 is equipped at its proximal end 10*a* with an injection head 20. One example of an injection head 20 is illustrated in FIGS. 12 and 13. It is preferably mounted removably at the proximal end 10*a* of the tube.

The injection head 20 comprises a fixed part 22 integral with the movement device 18 by means of a rod 23. The injection head 20 also comprises a pivoting part 24 configured to pivot with respect to the fixed part 22. Moreover, the injection head 20 comprises a hole 26 passing through the fixed 22 and pivoting 24 parts and therefore passing through the injection head, from top to bottom along an axis. Said axis is congruent with the boring direction Y when the tube 10 extends into said borehole. The fixed 22 and pivoting 24 parts have a substantially cylindrical shape. The pivoting part 24 cooperates with the proximal end 10*a* of the tube 10 so that it pivots in the boring direction Y when the tube is driven in rotation. In addition, the pivoting head comprises an opening 25 passing through the fixed 22 and pivoting 24 parts radially. The opening 25 leads into the through hole 26. Said opening 25 is configured to be connected to a supply source of washing fluid. The injection head also comprises pivoting seals 27 located between the pivoting part 24 and the fixed part 22.

A first blocking element 30 is then introduced into the borehole, as can be seen in FIG. 3. In this non-limiting example, the first blocking element 30 is inflatable and has a retracted position in which it is deflated, and a deployed position in which it is inflated. In addition, it is mounted on an injection channel 32, so that said injection channel 32 passes through the first blocking element 30. In addition, the first blocking element 30 is linked to an inflation member located outside the borehole, via an inflation duct. For reasons of legibility, said inflation member and said duct are not shown.

The first blocking element 30 is initially placed in the retracted position, around the injection channel 32. Said injection channel and said first blocking element in the retracted position are then introduced jointly into the tube 10, via the hole 24 passing through the injection head 20, and translated toward the bottom Fa of the borehole F. They are moved until the first blocking element 30 leaves the tube by its distal end 10*b*. The first blocking element is brought to a second predetermined depth P2, comprised between the first predetermined depth P1 and the borehole depth Pf. The first blocking element 30 then extends between the tube 10 and the bottom Fa of the borehole. The inflation duct and the injection channel 32 extend in the tube 10 and in the hole 26 passing through the injection head 20 and leading out of said injection head by its upper end.

Air is then injected into the first blocking element 30 via the duct, by means of the inflation member. The first blocking element is then inflated and placed in the deployed position illustrated in FIG. 4. It can therefore be deployed from outside the borehole.

In the deployed position, the first blocking element 30 molds itself to the lateral wall Fb of the borehole F so that it forms a plug between the parts of the borehole located above and below said first blocking element 30. The first blocking element then defines an injection zone 34 located between said first blocking element 30, the bottom Fa of the borehole F and the lateral wall Fb of the borehole. The injection zone 34 is located facing the first soil portion to be treated Z1.

The injection channel 32 is preferably connected to an injection fluid supply source. As can be noted in FIG. 4, the injection channel 32 passes through the injection head 20 and also extends inside the tube 10. It comprises a proximal end 32*a* protruding from the proximal end 10*a* of the tube and from the upper end of the injection head 20. The proximal end 32*a* of the injection channel 32 is linked to the injection fluid supply source. The injection channel 32 also comprises a distal end 32*b* then extending into the injection zone 34, below the first blocking element 30. The distal end of the injection channel 32 is equipped with an injection nozzle 36 configured to project an injection fluid. The injection channel 32 and the injection nozzle 36 are part of an injection device.

The injection of the injection fluid, illustrated in FIG. 5, is then carried out. The injection fluid can consist of a waterproofing product if it is necessary to waterproof the soil or of a hardenable mud if consolidation of the soil is required. It can also consist of a grout.

The injection fluid is introduced into the injection channel 32 at the proximal end 32*a* of said injection channel, and propagates in said injection channel from its proximal end until its distal end 32*b*. It is then injected into the injection zone 34 by means of the injection nozzle 36 which allows projecting it substantially radially toward the lateral wall Fb of the borehole F. The injected injection fluid is shown by the arrows drawn with solid lines. The injection fluid then infiltrated into the soil S and propagates into the first soil portion Z1 to be treated. The treatment of the soil is thereby accomplished.

The first blocking element 30 allows avoiding direct projection of the injection fluid toward the tube 10. As can be noted in FIG. 5, the injection fluid is, however, likely to bypass the first blocking element and accumulate between said first blocking element 30 and the tube 10 or even infiltrate between the tube 10 and the lateral wall Fb of the borehole. In particular, the injection fluid, possibly mixed with soil particles, forms cuttings which risk infiltrating between the lateral wall of the borehole and an outer surface 11 of the tube. This is not desirable, in that these cuttings risk perturbing the movement of the tube 10 or even to block the tube in the borehole.

In conformity with the invention, a step of removing the cuttings located between the tube 10 and the lateral wall Fb of the borehole is carried out, simultaneously with the injection of the injection fluid into the injection zone 34, so as to remove the cuttings in contact with said tube. More precisely, a step of cleaning the outer surface 11 of the tube is carried out. Advantageously, only the part of the tube which is in the soil is cleaned.

In this non-limiting example, in parallel with the injection of the injection fluid, the resisting torque applied to the tube is measured by means of the torque sensor 19. When this resisting torque is greater than a predetermined threshold, the presence of cuttings, and in particular of injection fluid in contact with the tube 10 is deduced from it, and the cleaning of the tube and the removal of the cuttings is then triggered.

Without departing from the scope of the invention, the step of removing the cuttings could be triggered starting with the beginning of the injection of the injection fluid into the injection zone 34.

In order to clean the tube 10 and to remove the cuttings, the tube 10 is rotated around an axis of rotation substantially congruent with the longitudinal direction Y of the borehole F by means of the movement device 18. Due to this rotation, the injection fluid in contact with the tube does not risk drying and solidifying. The risk that the tube remains caught in the soil is therefore strongly reduced. In addition, the rotation movement of the tube 10 has as its consequence moving the cuttings located between said tube and the lateral wall Fb of the borehole toward the proximal end 10*a* of the tube.

The rotation of the tube therefore allows effectively cleaning its outer surface 11 and rapidly removing cuttings.

Without departing from the scope of the invention, the outer surface 11 of the tube could comprise at least one screw conveyor allowing routing the cuttings toward the proximal end 10*a* of the tube and therefore toward the outside of the tube, to facilitate their removal.

In parallel, to clean the outer surface 11 of the tube and remove the cuttings, a step of injecting a washing fluid around the tube 10 is also carried out. The washing fluid can comprise an aqueous solution and cleaning agents. To accomplish this, the washing fluid is introduced into the tube at its proximal end 10*a*, via the opening provided in the fixed 22 and pivoting 24 parts of the injection head 20. The injection head 20 therefore allows injecting the washing fluid into the tube 10. The tube is then used as a duct, so that the washing fluid flows between the injection channel 32 and the tube 10. The washing fluid is brought to the distal end 10*b* of the tube, where it is injected into the borehole F. Insofar as the tube 10 pivots, the pivoting part 24 of the injection head 20 is also driven in rotation.

The washing fluid then progressively fills the upper part of the borehole located above the first blocking element and infiltrates between the outer surface 11 of the tube 10 and the lateral wall Fb of the borehole. The cuttings, comprising the injection fluid, present in this upper part of the borehole, then mix with the washing fluid so that the washing fluid drives the cuttings toward the upper end of the borehole and pushes them out of the borehole. This step allows removing the cuttings and cleaning more effectively the outer surface 11 of the tube 10.

In FIG. 5, the path of the washing fluid during its injection is shown by arrows drawn in dotted lines.

The coupled action of the washing fluid and the rotation of the tube allow more effectively separating the cuttings in contact with the tube. The rotation of the tube jointly with the injection of the washing fluid therefore allows very effective cleaning of the outer surface 11 of the tube 10, substantially reducing the risks of blockage of the tube 10 in the borehole F. The injection head 20 and the movement device 18 form a device for cleaning the tube 10 and therefore a device for removing the cuttings located between the tube 10 and the lateral wall Fb of the borehole F.

In FIG. 6, it is observed that the injection fluid has propagated in the first soil portion Z1 from the injection zone, so that this first soil portion Z1 has been treated. The dimensions of the first soil portion Z1 treated depend in particular on the injection time and on the quantity of injection fluid injected.

FIGS. 7 to 10 illustrate the treatment of the second soil portion Z2, distinct from the first treated soil portion Z1. The second soil portion Z2 to be treated extends between the first unstable soil part S1 and the second unstable soil part S2.

Firstly, the tube 10 is moved toward the top of the borehole F and positioned at a first secondary predetermined depth P1' less than the first predetermined depth P1. The tube 10 is then located facing the second unstable soil part S2 and allows holding the lateral wall Fb of the borehole F at this second unstable soil part S2.

As illustrated by the passage from FIG. 7 to FIG. 8, the first blocking element 30 is deflated and placed in the retracted position. It is then moved toward the top of the borehole F until a second secondary predetermined depth P2' less than the second predetermined depth P2.

As before, the first blocking element 30 is inflated so as to be placed in the deployed position in which it molds itself to the lateral wall Fb of the borehole. The first blocking element then defines a secondary injection zone 34' located between the first blocking element 30, the bottom Fa of the borehole F and the lateral wall Fb of the borehole. The secondary injection zone 34' is located in particular facing the second soil portion Z2 to be treated, as can be seen in FIG. 9.

The injection channel 32 and the injection nozzle 36 are also moved upward in the borehole, facing the second soil portion Z2 to be treated. As before, the injection fluid is injected into the secondary injection zone 34' so as to treat the second soil portion Z2. In parallel, the tube is cleaned and the cuttings located between the tube 10 and the lateral wall Fb of the borehole F are removed. To this end, the tube 10 is rotated by means of the movement device 18 and a washing fluid is injected into the borehole F and around the tube 10 by means of the injection head 20. There to, the circulation of the washing fluid allows avoiding having the cuttings, comprising the injection fluid, blocking the tube in the borehole.

As can be noted in FIG. 9, the injection fluid has infiltrated into the soil S so that the first soil portion Z1 and the second soil portion Z2 are treated.

According to a non-limiting variant, and as illustrated in FIG. 10, it would also have been possible to introduce a second blocking element 31 into the borehole at a third predetermined depth P3 comprised between the second secondary predetermined depth P2' and the borehole depth Pf. The second blocking element 31 is then located between the first blocking element 30 and the bottom of the borehole Fa.

The second blocking element 31 is similar to the first blocking element 30 and can also be placed in a deployed position. Consequently, it allows reducing the secondary injection zone 34', so that said secondary injection zone 34' extends henceforth between the first blocking element 30, the second blocking element 31 and the lateral wall Fb of the borehole. One advantage is to not project the injection fluid toward the bottom Fa of the borehole and therefore localizing the injection more precisely.

Without departing from the scope of the invention, the second blocking element 31 can have been introduced at the same time as the first blocking element 30, or afterward.

As illustrated in FIG. 11, it is then possible to extract the tube 10 from the borehole, while still moving the guiding member 18 along the mast. The first blocking element 30 is also extracted after having placed it in the retracted position.

The treatment of the first and second soil portions Z1, Z2 has therefore been accomplished by moving upward, in two successive injection steps, toward the top of the borehole F.

The invention claimed is:

1. A method for treating soil, comprising:

supplying a tube having a distal end;

making a borehole in the soil, the borehole having a bottom, a lateral wall, a borehole depth and extending in a boring direction;

positioning the tube in the borehole at a first predetermined depth less than the borehole depth;

introducing at least one first blocking element into the borehole at a second predetermined depth comprised between the first predetermined depth and the borehole depth, so that the at least one first blocking element extends between the distal end of the tube and the bottom of the borehole, said at least one first blocking element being configured to block the borehole in order to define an injection zone located between said at least one first blocking element, the bottom of the borehole, and the lateral wall of the borehole; and injecting an injection fluid into the injection zone while removing cuttings formed by the injection fluid, possibly mixed with particles of soil, and located between the tube and the lateral wall of the borehole, wherein removing the cuttings comprises cleaning of the outer surface of the tube, and wherein cleaning the outer surface of the tube comprises injecting a washing fluid around the tube.

2. The method according to claim 1, wherein removing the cuttings comprises cleaning an outer surface of the tube.

3. The method according to claim 2, wherein cleaning the outer surface of the tube comprises rotating said tube around the boring direction.

4. The method according to claim 1, wherein the distal end of the tube bears a cutting member, and wherein making the borehole in the soil comprises moving the tube in the soil in the boring direction until the borehole depth.

5. The method according to claim 1, wherein the diameter of the tube is substantially equal to the diameter of the borehole.

6. The method according to claim 1, comprising:

providing a torque sensor;

measuring, using the torque sensor, a resisting torque applied to the tube; and detecting a possible presence of cuttings in contact with the tube based on the measured resisting torque.

7. The method according to claim 1, wherein said at least one first blocking element has a retracted position in which the at least one first blocking element can be moved in the borehole, and a deployed position in which the at least one first blocking element cooperates with the lateral wall of the borehole to block the borehole in order to define said injection zone.

8. The method according to claim 7, wherein said at least one first blocking element is inflatable.

9. The method according to claim 7, wherein introducing said at least one first blocking element into the borehole comprises introducing said first blocking element, in the retracted position, into the tube and moving said first blocking element along the tube until the second predetermined depth.

10. The method according to claim 1, wherein injecting the injection fluid comprises injecting the fluid using an injection device comprising an injection channel extending inside the tube and leading into the injection zone.

11. The method according to claim 10, wherein the injection channel passes through said at least one first blocking element.

12. The method according to claim 1, comprising introducing a second blocking element into the borehole at a third predetermined depth comprised between the second predetermined depth and the borehole depth, so that the second blocking element is located between said at least one first blocking element and the bottom of the borehole, said second blocking element being configured to block the borehole so that the injection zone extends between the at least one first blocking element, the second blocking element, and the lateral wall of the borehole.

13. The method according to claim 12, comprising introducing the first and second blocking elements into the borehole at the same time.

14. The method according to claim 1, wherein the injection fluid is selected among a waterproofing product and a hardenable mud configured to consolidate the soil.

15. The method according to claim 1, comprising:

providing a torque sensor;

measuring, using the torque sensor, a resisting torque applied to the tube;

detecting a possible presence of cuttings in contact with the tube based on the measured resisting torque; and injecting the washing fluid if a presence of cuttings in contact with the tube is detected.

16. The method according to claim 1, wherein the washing fluid is injected by the distal end of the tube.

17. The method according to claim 16, wherein injecting the washing fluid comprises injecting the washing fluid using an injection head configured to inject the washing fluid into the tube, the injection head comprising a fixed part and a pivoting part, the pivoting part being configured to cooperate with the tube.

18. The method of claim 1, further comprising:

wherein removing the cuttings prevents the tube from being blocked by the cuttings in the borehole.

19. A device for treating soil in which a borehole is made, the borehole having a bottom, a lateral wall, a borehole depth and extending in a boring direction, the device comprising:

a tube having a distal end, said tube being configured to be positioned in the borehole at a first predetermined depth less than the borehole depth;

at least one first blocking element configured to be introduced into the borehole at a second predetermined depth comprised between the first predetermined depth and the borehole depth, said at least one first blocking element being configured to block the borehole in order to define an injection zone located between said at least one first blocking element, the bottom of the borehole and the lateral wall of the borehole;

an injection device configured to inject an injection fluid into the borehole; and a device for removing cuttings configured to remove the cuttings formed by the injection fluid, possibly mixed with particles of soil, and located between the tube and the lateral wall of the borehole during the injection of the injection fluid into the borehole, by cleaning the outer surface of the tube by injecting a washing fluid around the tube.

20. The device according to claim 19, wherein the device for removing the cuttings comprises a movement device configured to set the tube in rotation around the boring direction.

21. The treatment device according to claim 19, wherein the device for removing the cuttings comprises an injection head for injecting a washing fluid around the tube.

22. A method for treating soil, comprising:

supplying a tube having a distal end;

making a borehole in the soil, the borehole having a bottom, a lateral wall, a borehole depth and extending in a boring direction;

positioning the tube in the borehole at a first predetermined depth less than the borehole depth;

introducing at least one first blocking element into the borehole at a second predetermined depth comprised between the first predetermined depth and the borehole depth, so that the at least one first blocking element extends between the distal end of the tube and the bottom of the borehole, said at least one first blocking element being configured to block the borehole in order to define an injection zone located between said at least one first blocking element, the bottom of the borehole, and the lateral wall of the borehole;

providing a torque sensor;

injecting an injection fluid into the injection zone while measuring, using the torque sensor, a resisting torque applied to the tube;

detecting a possible presence of cuttings in contact with the tube based on the measured resisting torque; and injecting a washing fluid around the tube if a presence of cuttings, formed by the injection fluid possibly mixed with particles of soil, in contact with the tube is detected, so as to remove said cuttings located between the tube and the lateral wall of the borehole, in order to clean the outer surface of the tube.

23. A device for treating soil in which a borehole is made, the borehole having a bottom, a lateral wall, a borehole depth and extending in a boring direction, the device comprising:

a tube having a distal end, said tube being configured to be positioned in the borehole at a first predetermined depth less than the borehole depth;

at least one first blocking element configured to be introduced into the borehole at a second predetermined depth comprised between the first predetermined depth and the borehole depth, said at least one first blocking element being configured to block the borehole in order to define an injection zone located between said at least one first blocking element, the bottom of the borehole and the lateral wall of the borehole;

an injection device configured to inject an injection fluid into the borehole; and a device for removing cuttings configured to remove the cuttings formed by the injection fluid located between the tube and the lateral wall of the borehole during the injection of the injection fluid into the borehole, the device for removing the cuttings comprising a movement device configured to set the tube in rotation around the boring direction, the device for removing the cuttings further comprising an injection head for injecting a washing fluid around the tube, the injection head comprising a fixed part and a pivoting part, the pivoting part cooperating with a proximal end of the tube, the injection head comprising a lateral wall in which an opening is provided, that passes through the fixed part and the pivoting part, said opening being configured to be connected to a washing fluid supply source for flowing said washing fluid inside the tube.

* * * * *